United States Patent [19]

Cotton

[11] 4,362,954

[45] Dec. 7, 1982

[54] POWER-UP CONTROL FOR MICROPROCESSOR BASED APPLIANCE

[75] Inventor: Curran D. Cotton, Newton, Iowa

[73] Assignee: The Maytag Company, Newton, Iowa

[21] Appl. No.: 305,558

[22] Filed: Sep. 25, 1981

[51] Int. Cl.[3] ..... H01H 3/00; H01H 13/70

[52] U.S. Cl. ..... 307/142; 200/5 A

[58] Field of Search ..... 307/142, 113, 115; 200/5 E, 5 A, 292; 34/45; 335/15, 21; 337/70

[56] References Cited

U.S. PATENT DOCUMENTS

| | | | |
|---|---|---|---|
| 3,136,984 | 6/1964 | Morrongiello | 307/115 X |
| 3,662,475 | 5/1972 | Beller et al. | 34/45 |
| 3,673,531 | 6/1972 | Zane | 337/77 |
| 4,161,918 | 7/1979 | Dunn | 307/115 X |
| 4,209,915 | 7/1980 | Keuleman et al. | 34/48 |
| 4,228,330 | 10/1980 | Larson | 200/5 A |
| 4,258,096 | 3/1981 | LaMarche | 200/5 A X |
| 4,308,439 | 12/1981 | Itoh | 200/292 X |

FOREIGN PATENT DOCUMENTS

| | | | |
|---|---|---|---|
| 2217445 | 10/1973 | Fed. Rep. of Germany | 200/5 E |

*Primary Examiner*—Donald A. Griffin
*Attorney, Agent, or Firm*—Richard L. Ward

[57] ABSTRACT

A microprocessor controlled appliance is provided which has a smooth unbroken control surface. A control panel assembly includes a support panel and a decorative panel overlying the support panel. The assembly further includes a continuous flexible membrane layer. The support and decorative panels each include a generally aligned opening providing rear communication with the flexible membrane layer. A power source provides power between a pair of electrical conductors for energizing the appliance. A manually-set electrically-reset switch is associated with one of the conductors and is mounted to the support panel below the flexible membrane layer. The switch is manually operable to a closed position by depressing the membrane layer through the opening to complete a circuit across the pair of conductors for powering-up the microprocessor controlled appliance. Mechanism is provided for holding the switch in the closed position including a portion engageable with the switch. A device is operable responsive to the microprocessor for effecting disengagement of the mechanism to effect resetting of the switch to its normally open position.

14 Claims, 6 Drawing Figures

POWER-UP CONTROL FOR MICROPROCESSOR BASED APPLIANCE

BACKGROUND OF THE INVENTION

This invention relates generally to the field of control circuitry for appliances and more particularly to circuitry for powering up a microprocessor based appliance including an electromechanical switch located behind a membrane touch panel.

There has been shown in prior appliance panel switch mounting construction various switches which are manually operable for being set and latched in a contact closed or conductive posture. At a predetermined time in a cycle of operations these switches are electrically reset or returned to a contact open or nonconductive posture. Zane, U.S. Pat. No. 3,673,531, is an example of a multi-button switch mechanism generally used in the control panel of a dishwasher. At least one of the several switches in this mechanism is manually set to a closed posture and at a predetermined time in the dishwasher cycle of operations a bimetallic heating element is actuated through the timer to release the switch allowing it to return to its open posture.

Keuleman et al in U.S. Pat. No. 4,209,915, also teaches a mechanical push button switch for initiating a cycle of events. A holding capacitor is charged and is eventually discharged through a transistor circuit which is turned on by a controller for terminating operations. A relay operates to hold the switch contact in the closed posture until the operations are terminated.

While the above constructions disclose manually-set electrically-reset switch mechanisms it is desirable in an appliance having a touch membrane type switch to provide a completely smooth control panel surface. This desirable feature has not been shown in the prior art in conjunction with a manually-set electrically-reset start switch mounted behind a smooth flexible control panel surface and operable by depressing the smooth flexible membrane surface of the control panel. There is thus provided herein a manually-set electrically-reset switch operable for powering-up a microprocessor control circuit while maintaining the smooth unbroken surface appearance of a flexible membrane control panel surface.

SUMMARY OF THE INVENTION

It is therefore an object of the instant invention to provide an improved power-up circuit with electrical isolation of the microprocessor control through the use of a manually-set electrically-reset start switch.

It is a further object of the instant invention to preserve the smooth unbroken appearance of a membrane switch control panel while utilizing an electromechanical start switch in conjunction with a membrane switch array.

It is another object of the instant invention to utilize an electromechanical switching device while substantially maintaining the feel of a flexible membrane switch.

Briefly, the instant invention achieves these objects in a microprocessor controlled appliance having a smooth unbroken control panel surface. A control panel is provided which includes a support panel and a decorative panel overlying the support panel and further including a continuous flexible membrane layer substantially covering the decorative panel. The support and decorative panel have at least one aligned opening for providing rear communication with the flexible membrane layer. A power source provides power between a pair of electrical conductors. A manually-set electrically-reset switch is mounted on the support panel juxtaposed to the opening and is electrically associated with one of the conductors. The switch is manually operable to a closed position by depressing the flexible membrane layer to complete a circuit for powering-up the microprocessor control. An electromechanical device includes a portion biased into engagement with the switch for holding the switch in the closed posture. An electrical device is operable responsive to the microprocessor for controlling operation of the electromechanical device to effect movement of the electromechanical device out of engagement with the switch allowing the switch to return to its normally open position.

Operation of the circuit and further objects and advantages thereof will become evident as the description proceeds and from an examination of the accompanying two sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
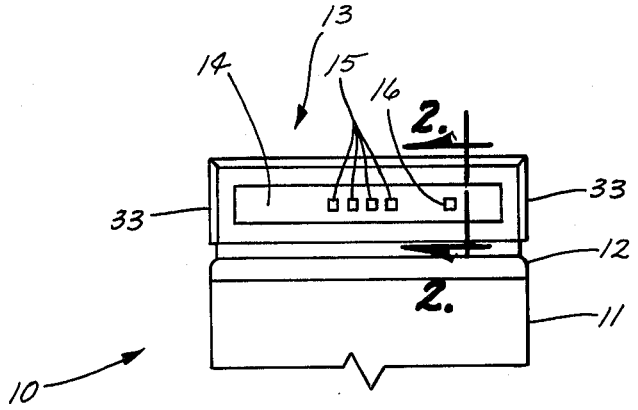
FIG. 1 is a partial front elevation view of an appliance including a touch actuated control panel.

Referring now to the drawings and in particular to FIG. 1, there is shown a free-standing appliance 10 having a cabinet 11 and a top cover 12. Extending upwardly from the top cover 12 is a control housing 13 for mounting various control members. In a preferred embodiment, the control housing 13 includes a unitary smooth membrane surface 14 having a plurality of cycle selection touch switches 15 and a touch start switch 16 incorporated therein as indicated by the touch pads shown in FIG. 1. The touch switches 15 and 16 are operable to closed postures by an operator depressing the membrane surface 14. The membrane surface 14 is required to move only about seven thousandths of an inch to make electrical contact at the cycle selection touch switches 15 and about thirty thousandths of an inch to make contact at the touch start switch 16.

Figure 2:
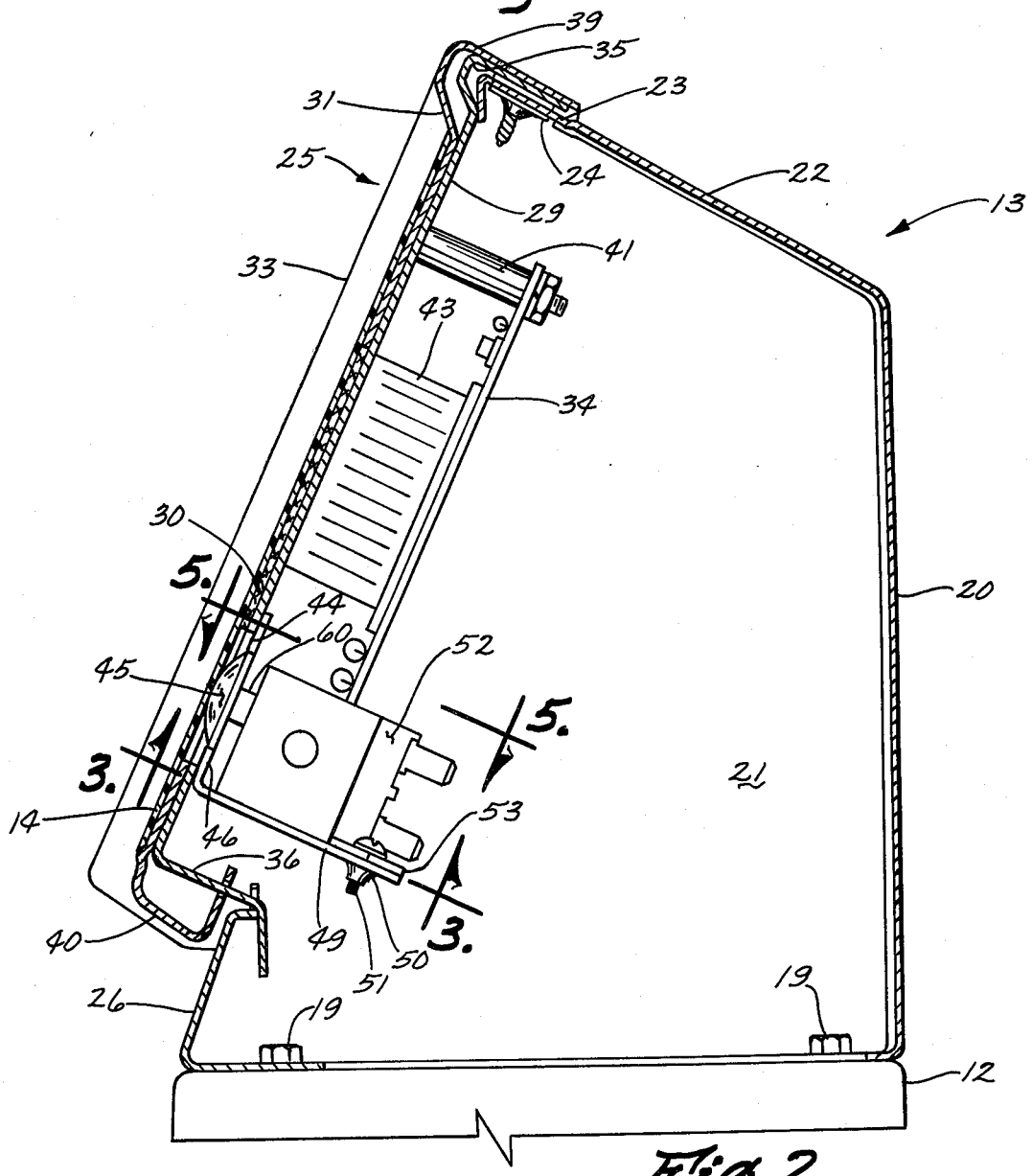
FIG. 2 is a sectional view through the control housing and panel assembly taken generally along lines 2—2 of FIG. 1.

As best shown in FIG. 2, the control housing 13 is secured to the top cover 12 by a plurality of thread forming fasteners 19 which tap into pilot holes in the mounting surface of the top cover 12. The control housing 13 is formed from sheet metal and includes substantially vertical rear and side walls 20 and 21 as shown in FIG. 2. A top wall 22 extends angularly upward and forward from the top of the rear wall 20. The front edge 23 of the top wall 22 is downwardly embossed by at least a metal thickness to receive a spring clip fastener 24 for use in securing a control panel assembly 25 to the control housing 13.

The front of the control housing 13 is generally open. A lower front wall 26 joins the two side walls 21 and extends upwardly and rearwardly generally toward the front edge 23 of the top wall 22 for a distance equal to about one-tenth the total front area with the remaining nine-tenths of the area being open. The frontal opening of the control housing 13 is closed by the control panel assembly 25 comprising a support panel 29, a membrane switch 30, a decorative panel 31 including the flexible plastic membrane surface or layer 14 and a pair of end caps 33. The support panel 29 is formed from sheet material and is generally horizontally elongated to cover the frontal opening of the control housing 13. The support panel 29 is generally utilized for mounting the membrane switch 30, a circuit board 34 and other elements necessary for control of the appliance 10. The support panel 29 includes upper and lower rearwardly projecting shoulder portions 35 and 36 which are engageable with the front edge 23 of the control housing top wall 22 and the lip of the control housing lower front wall 26, respectively.

The decorative panel 31 is also horizontally elongated and generally overlies the support panel 29. The decorative panel 31 is formed from a unitary sheet of material and includes a forwardly facing body portion, an upper flange portion 39 and a lower flange portion 40. The forwardly facing body portion of the decorative panel 31 is cut out for receiving the generally rectangular membrane switch 30. A flexible plastic overlay material is laminated to the body portion of the decorative panel 31 to cover the membrane switch 30 and provide the smooth continuous outer panel membrane surface 14. As best shown in FIG. 2, the decorative panel 31 overlies the support panel 29 and the membrane switch 30 is sandwiched between the support panel 29 and the rear of the membrane surface or layer 14.

Secured to and spaced from the rear of the support panel 29 through the use of stand-off posts 41 is the circuit board 34 for mounting the various control elements of the appliance 10. The circuit board 34 and its components communicate with the membrane switch 30 through a flat electrical cable 43 extending therebetween.

Figure 3:
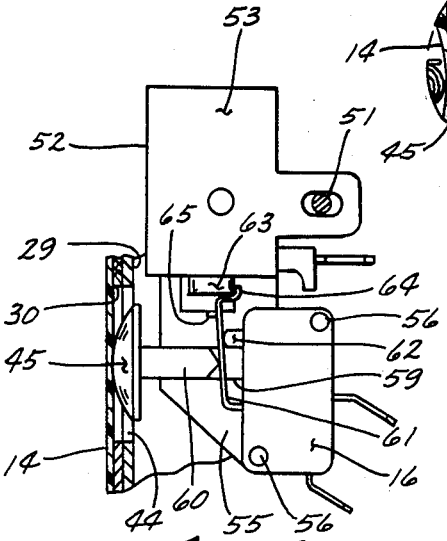
FIG. 3 is a section view taken generally along lines 3—3 of FIG. 2 and showing the switch mechanism in the normally open posture.
Figure 4:
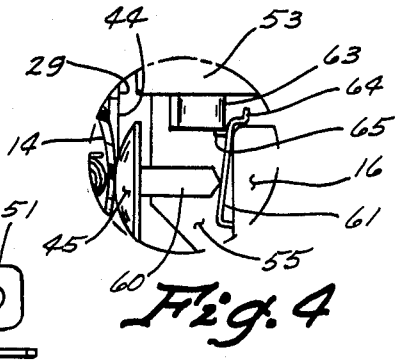
FIG. 4 is a fragmentary view similar to FIG. 3 and showing the switch moved to the contact closed posture.
Figure 5:
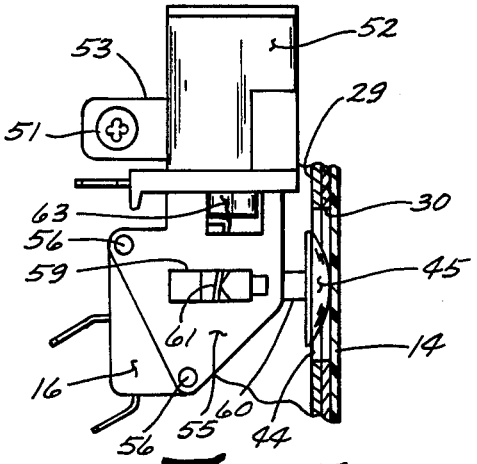
FIG. 5 is a view taken generally along lines 5—5 of FIG. 2 and showing another view of the switch mechanism.

The support panel 29 and decorative panel 31 include substantially aligned openings 44 for permitting the push button 45 of the touch start switch 16 to contact the rear of the membrane surface 14. As further shown in FIG. 2, a mounting bracket 46 is secured to the rear of the support panel 29 adjacent the openings 44. The mounting bracket 46 includes a portion 49 generally perpendicular to the rear of the support panel 29 having at least one extruded hole 50 for receiving a self-threading fastener 51 for securing a combination touch start switch 16, push button 45 and solenoid 52 assembly to the rear of the support panel 29 as shown in FIGS. 3, 4 and 5. These components are mounted on a sheet metal bracket 53 which is formed to include a generally C-shaped segment for capturing the coil portion of the solenoid 52. The sheet metal bracket 53 further includes a wall portion 55 depending from one leg of the C-shaped segment for mounting the normally open start switch 16 through a pair of mechanical fasteners 56 such as rivets. The wall portion 55 also includes a notch 59 to capture a slider segment 60 of the push button 45 for movement along a line generally perpendicular to the switch 16.

As best shown in FIG. 3, the switch 16 includes an actuator lever 61 extending along the side of the switch body and over the top of the actuator button 62. The actuator lever 61 is operable for depressing the actuator button 62 to close the contacts of the switch 16 when the push button 45 is actuated. In this construction, the actuator lever 61 is modified to capture the axially biased plunger 63 of the solenoid 52. As shown in FIGS. 3 and 4, the end of the actuator lever 61 adjacent the plunger 63 includes an offset portion 64 and a stop 65 for engaging with the plunger 63 in the plunger-retracted and plunger-extended postures respectively.

FIGS. 3 and 5 show the plunger 63 retained by the offset portion 64 of the actuator lever 61 when the plunger 63 is in the retracted posture corresponding to the normally open position of the switch 16. If the push button 45 is manually depressed through the membrane surface 14 as shown in FIG. 4, the actuator lever 61 will be moved to depress the actuator button 62. In this posture of the push button 45 and the actuator lever 61, the axially biased solenoid plunger 63 will move to the extended posture to engage the stop 65 of the actuator lever 61 for retaining the switch 16 in the closed position.

Figure 6:
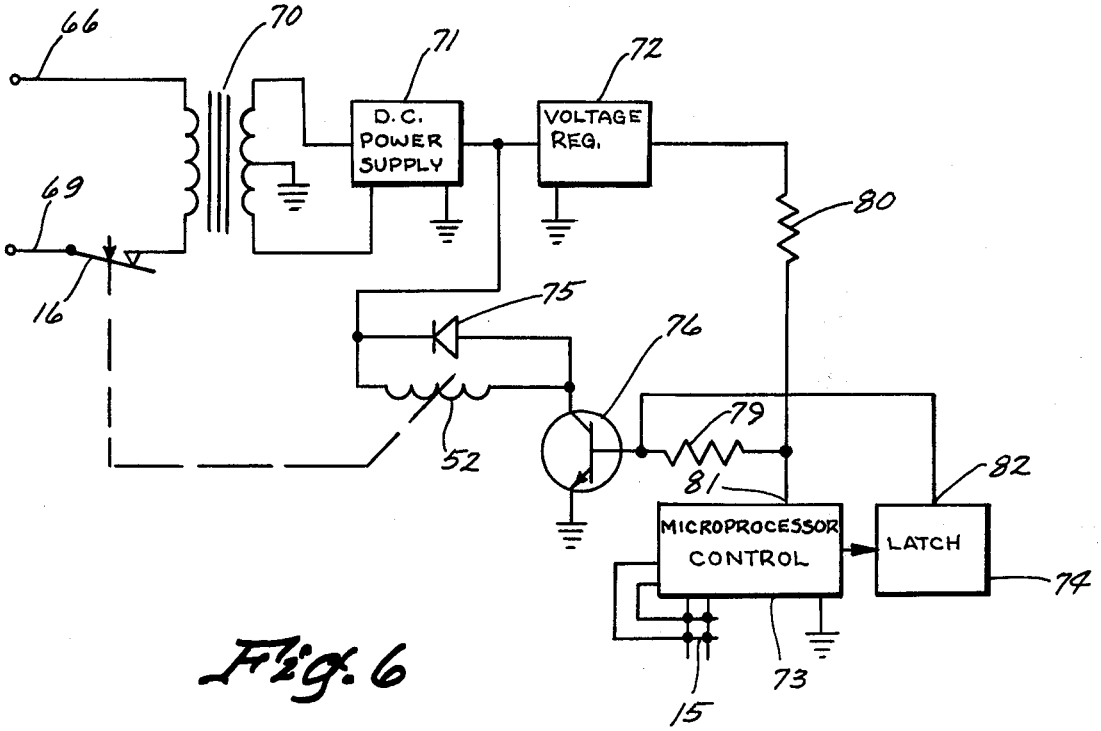
FIG. 6 is a schematic diagram of the appliance power-up circuit.

Turning now to FIG. 6 there is shown an electrical circuit for energizing or powering-up the microprocessor based appliance control. The electrical circuit includes a source of 120 volts RMS alternating current through the conductors 66 and 69. The electrical circuit further includes a step-down transformer 70, a direct current power supply 71, a voltage regulator 72, a microprocessor control 73, a National Semiconductor MM 5450 latch 74, the normally open switch 16 and solenoid 52 as previously discussed, a diode 75 in parallel with the coil of the solenoid 52, a transistor 76 and a pair of resistors 79 and 80.

Referring once again to FIG. 4 and also to FIG. 6, as the push button 45 is moved by depressing the flexible membrane surface 14 of the control panel assembly 25, the axially biased plunger 63 of the solenoid 52 is released from the offset portion 64 of the actuator lever 61 and engages with the stop 65. Engagement with the stop 65 will maintain the switch 16 in the closed position for energizing the microprocessor control 73 across the 120 volt RMS source through the conductors 66 and 69.

The step-down transformer 70 is operable for converting the 120 volt RMS input to 18 volts RMS across its secondary winding. The direct current power supply 71 then rectifies the secondary current creating a 25.5 volt peak potential. The voltage regulator 72 provides a regulated 5 volts direct current for powering the microprocessor control 73 which in this embodiment is a National Semiconductor COPS 420/421 N-channel microcontroller. The microprocessor control 73 is provided with a plurality of cycle selection touch switches 15 in the membrane switch 30 of the control panel assembly 25 for inputting information to interface with the microprocessor control 73.

In the circuitry of FIG. 6, transistor 76 is provided for energizing the solenoid 52. Energization of the solenoid 52 will retract the plunger 63 and allow the normally open switch 16 to reset to the normally open position which will terminate operation of the appliance 10. The diode 75, in parallel with the solenoid 52, provides a snubber path around the solenoid 52 which allows the field of the solenoid 52 to collapse upon termination of operation without the appearance of voltage spikes on the collector of transistor 76. The operation of the transistor 76 and solenoid 52 will be further discussed herein.

Power-up of the microprocessor control 73 is achieved by manually depressing the push button 45 of the normally open switch 16 through the membrane surface 14 of the decorative panel 31 to move or set the contacts of the normally open switch 16 to the closed position. The closed position of the normally open switch 16 connects the step-down transformer 70 across the 120 volt RMS source through the conductors 66 and 69 and thereby provides a step-down voltage to the direct current power supply 71. The output of the direct current power supply 71 feeds the voltage regulator 72 to provide a regulated voltage for the microprocessor control 73. The output of the direct current power supply also provides power for energizing the solenoid 52.

The base of transistor 76 is connected to terminal 81 of the microprocessor control 73 through resistor 79 and is also connected to terminal 82 of the MM5450 latch 74. This dual connection exists for initializing purposes only: once the appliance 10 has been powered up by manually closing the normally open switch 16, the voltage regulator 72 provides a 5 volt potential to both the microprocessor control 73 and the MM5450 latch 74. Upon initialization, it is the characteristic of the microprocessor control 73 to cause terminal 81 to become a logic 0. It is further the characteristic of the MM5450 latch 74 upon initialization to cause terminal 82 to be a logic 1. Shortly after initialization, under program control, the microprocessor control 73 programs the MM5450 latch 74 in such a manner that terminal 82 also becomes a logic 0. This condition is required during normal operation of the appliance 10. For purposes of the electrical circuitry of FIG. 6, a logic 0 can be considered to be essentially a neutral circuit condition and a logic 1 can be considered to be a positive 5 volt potential with respect to common or ground connection. If the junction of resistors 79 and 80 were not connected to the logic 0 terminal 81 on the microprocessor control 73, during initialization the 5 volt output of the voltage regulator 72 would cause the transistor 76 to conduct by providing base current through resistors 79 and 80. This transient condition would attempt to cause the solenoid 52 to unlatch or reset the normally open switch 16 being held in the closed position to power-up the appliance 10. The connection at terminal 81 therefore insures that transistor 76 is held in an off condition until the microprocessor control 73 can properly initialize the condition of terminal 82 of the MM5450 latch 74 to a logic 0. Once this is accomplished, terminal 81 is configured as a logic 1.

Upon completion of a cycle of operation, the microprocessor control causes terminal 82 of the MM5450 latch 74 to become a logic 1. This places a 5 volt potential at the base of transistor 76 causing base current to flow forcing it into conduction for energizing the solenoid 52. This energization retracts the plunger 63 and allows the normally open switch 16 to be reset to the normally open position thereby terminating operation of the appliance 10.

It is thus seen that the instant invention provides a unique power-up circuit for a microprocessor control 73 which provides for electrical isolation of the microprocessor control 73 through a manual-set electrically-reset switch 16. The instant invention also provides for the utilization of a smooth unbroken control panel surface while utilizing an electromechanical switch 16 and maintains the feel of a flexible membrane switch 30.

In the drawings and specification, there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

I claim:

1. An appliance control center, the combination comprising: a control center housing having an opening for providing access into said housing; panel means for substantially closing said opening including a support panel and a decorative panel overlying said support panel and further including a smooth flexible membrane layer overlying said decorative panel, said support and decorative panels each including at least one generally aligned opening; and switch means associated with said panel means including an electromechanical switch juxtaposed to said support panel with a push button actuator extending into said opening in contact with the rear of said flexible membrane layer amd manually operable therethrough, said switch means further including touch switch means sandwiched between said flexible membrane layer and said support panel whereby said touch switch means and electromechanical switch are integrated into said control center to provide a control center including electromechanical and touch switches and having a smooth unbroken control surface.

2. A microprocessor controlled appliance having a smooth unbroken control panel surface, the combination comprising: control panel means associated with said appliance including a support panel and a decorative panel overlying said support panel and further including a continuous flexible membrane layer, said support and decorative panels including at least one generally aligned opening to provide rear communication with said flexible membrane layer; a power source providing electrical power between a pair of electrical conductors for energizing said appliance; manually-set electrically-reset switch means mounted to said support panel adjacent said flexible membrane layer and electrically associated with one of said conductors, said switch means manually operable to a closed position by depressing said membrane layer through said opening to complete a circuit across said pair of conductors for powering up said microprocessor controlled appliance; means for holding said switch means in said closed position including means engageable with said switch means; and means operable responsive to said microprocessor for effecting disengagement of said means engageable to effect resetting of said switch means to its normally open position.

3. An appliance as defined in claim 2 wherein said flexible membrane layer is joined to said decorative panel to provide said smooth unbroken control surface.

4. An appliance as defined in claim 2 and further including switch actuator means in communication with the rear of said flexible membrane layer through said opening.

5. An appliance as defined in claim 4 wherein said means for holding includes a solenoid having a plunger axially biased into engagement with said switch actuator means.

6. An appliance as defined in claim 2 wherein said manually-set electrically-reset switch means is operable for switching relatively high voltages from said power source.

7. An appliance as defined in claim 2 and further including membrane touch switch means interfaced with said microprocessor and operable for switching relatively low voltages.

8. A microprocessor controlled appliance having a smooth unbroken control panel surface, the combination comprising: control panel means associated with said appliance including a support panel and a decorative panel overlying said support panel and further including a continuous flexible membrane layer substantially covering said decorative panel, said support and decorative panels including at least one generally aligned opening for providing rear communication with said flexible membrane layer; a power source for providing relatively high voltage power between a pair of electrical conductors; a manually-set electrically-reset switch electrically associated with one of said conductors and mounted juxtaposed to said one opening behind said support panel; switch actuator means adjacent said flexible membrane surface and manually operable for closing said switch by depressing said flexible membrane layer through said opening to complete a circuit across said conductors for powering up said microprocessor controlled appliance; electromechanical means biased into engagement with said actuator means for holding said switch in said closed posture; and means operable responsive to said microprocessor for controlling energization of said electromechanical means to effect movement of said electromechanical means out of engagement with said actuator means allowing said switch to reset to its normally open position.

9. An appliance as defined in claim 8 wherein said actuator means includes a push button in communication with the rear of said flexible membrane layer and an actuator arm engageable by said push button to effect the closing of said switch.

10. An appliance as defined in claim 8 wherein said electromechanical means includes a solenoid having a plunger axially biased into engagement with said actuator means.

11. An appliance as defined in claim 8 wherein said means operable responsive to said microprocessor includes a semiconductor device operable for conducting current to energize said electromechanical means and effect resetting of said switch to its normally open position.

12. An appliance as defined in claim 8 and further including low voltage membrane touch switch means sandwiched between said flexible membrane layer and said support panel and interfaced with said microprocessor.

13. An appliance control center, the combination comprising: a control center housing having an opening for providing access into said housing; panel means for substantially closing said opening including a front surface and further including a generally imperforate smooth flexible membrane layer overlying said front surface, said panel means including at least one opening covered by said membrane layer; and switch means associated with said panel means including an electromechanical switch having an actuator extending into said opening for contact with the rear of said flexible membrane layer and manually operable therethrough and further including touch switch means operable through said flexible membrane layer whereby said touch switch means and electromechanical switch are integrated into said control center to provide a control center including electromechanical and touch switches and having a smooth unbroken control surface.

14. An appliance control center as defined in claim 13 wherein said panel means includes a support panel and a decorative panel overlying said support panel.

* * * * *